US009810465B2

(12) United States Patent
Kang et al.

(10) Patent No.: US 9,810,465 B2
(45) Date of Patent: Nov. 7, 2017

(54) HEAT PUMP SYSTEM FOR VEHICLE

(71) Applicant: HALLA VISTEON CLIMATE CONTROL CORP., Daedeok-gu, Daejeon (KR)

(72) Inventors: Sung Ho Kang, Daejeon (KR); Hak Kyu Kim, Daejeon (KR); Sang Ki Lee, Daejeon (KR); Young Ho Choi, Daejeon (KR); Jae Min Lee, Daejeon (KR); Jung Jae Lee, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 386 days.

(21) Appl. No.: 14/508,449

(22) Filed: Oct. 7, 2014

(65) Prior Publication Data

US 2015/0096319 A1 Apr. 9, 2015

(30) Foreign Application Priority Data

Oct. 8, 2013 (KR) ..... 10-2013-0119681
Sep. 22, 2014 (KR) ..... 10-2014-0125970

(51) Int. Cl.

| | |
|---|---|
| ***F25B 49/02*** | (2006.01) |
| ***F25B 41/04*** | (2006.01) |
| ***F25B 30/02*** | (2006.01) |
| ***F25B 5/00*** | (2006.01) |
| ***F25B 6/04*** | (2006.01) |
| ***F25B 41/06*** | (2006.01) |
| *F25B 40/00* | (2006.01) |

(52) U.S. Cl.

CPC ..... *F25B 49/02* (2013.01); *F25B 5/00* (2013.01); *F25B 6/04* (2013.01); *F25B 30/02* (2013.01); *F25B 41/046* (2013.01); *F25B 41/062* (2013.01); *F25B 40/00* (2013.01); *F25B 2341/0662* (2013.01); *F25B 2400/0409* (2013.01); *F25B 2600/2515* (2013.01); *F25B 2600/2519* (2013.01)

(58) Field of Classification Search

CPC ..... F25B 49/02; F25B 5/00; F25B 41/062; F25B 6/04; F25B 30/02; F25B 2600/2519; F25B 2600/2515; F25B 41/046; F25B 41/04

See application file for complete search history.

(56) References Cited

U.S. PATENT DOCUMENTS 3,973,410 A * 8/1976 Putman ..... F25B 41/062 137/517
4,065,096 A * 12/1977 Frantz ..... F16K 31/0679 137/561 R
4,632,358 A * 12/1986 Orth ..... B60H 1/00485 251/117
4,716,741 A * 1/1988 Bednarek ..... F25B 13/00 62/197

(Continued)

FOREIGN PATENT DOCUMENTS

EP 2634021 A1 9/2013

*Primary Examiner* — Kun Kai Ma
(74) *Attorney, Agent, or Firm* — Dickinson Wright PLLC

(57) ABSTRACT

A heat pump system for a vehicle delays the change of the direction of a directional valve for a given period of time and then conducts the change of the direction of the directional valve, upon receiving the mode change signal between an air conditioner mode and a heat pump mode, thus preventing the generation of the noise and vibration caused by the differential pressure of a refrigerant.

17 Claims, 7 Drawing Sheets

(56) References Cited

U.S. PATENT DOCUMENTS 4,911,358 A * 3/1990 Mehta ..... G05D 23/1904 165/239
5,632,156 A * 5/1997 Takeo ..... B60H 1/3205 62/160
6,289,930 B1 * 9/2001 Simon ..... F16K 31/406 137/601.14
6,314,750 B1 * 11/2001 Ishikawa ..... B60H 1/00921 62/129
7,207,379 B2 * 4/2007 Takano ..... B60H 1/3208 165/202
2002/0157414 A1 * 10/2002 Iwanami ..... B60H 1/00778 62/239
2003/0151011 A1 * 8/2003 Hirota ..... F16K 31/406 251/30.01
2004/0079096 A1 * 4/2004 Itoh ..... B60H 1/00735 62/223
2004/0103676 A1 * 6/2004 Lee ..... F25B 13/00 62/160
2004/0222395 A1 * 11/2004 Yee ..... F15C 5/00 251/65
2005/0056034 A1 * 3/2005 Hirota ..... F25B 41/062 62/222
2008/0042088 A1 * 2/2008 Suzuki ..... F16K 31/404 251/129.08
2009/0088292 A1 * 4/2009 Sasakura ..... B60W 30/194 477/78
2010/0293978 A1 * 11/2010 Thybo ..... F25B 41/062 62/222
2011/0082602 A1 * 4/2011 Tanaka ..... F24F 11/006 700/300
2011/0167849 A1 * 7/2011 Kobayashi ..... B60H 1/00914 62/159
2012/0227431 A1 * 9/2012 Wang ..... B60H 1/00921 62/238.7
2012/0255319 A1 * 10/2012 Itoh ..... F24F 3/1405 62/160
2012/0318013 A1 * 12/2012 Hozumi ..... B60H 1/3213 62/181
2013/0081419 A1 * 4/2013 Katoh ..... B60H 1/004 62/278
2013/0082199 A1 * 4/2013 Matsumoto ..... F16K 31/408 251/129.07
2013/0206851 A1 * 8/2013 Sekiguchi ..... F16K 31/04 236/92 B
2013/0313461 A1 * 11/2013 Tonegawa ..... F25B 41/062 251/318
2014/0111261 A1 * 4/2014 Daigo ..... H03K 17/14 327/161
2014/0238067 A1 * 8/2014 Itou ..... F25B 41/04 62/324.6
2014/0290772 A1 * 10/2014 Itou ..... F25B 41/062 137/625.12
2015/0096630 A1 * 4/2015 Ogawa ..... F16K 31/406 137/487.5
2015/0260439 A1 * 9/2015 Ohta ..... F25B 5/00 62/196.1
2016/0131403 A1 * 5/2016 Andoh ..... F16K 27/029 62/160

* cited by examiner

PRIOR ART

On/off valve closed (expanded)

On/off valve open (unexpanded)

HEAT PUMP SYSTEM FOR VEHICLE

CROSS REFERENCE TO RELATED APPLICATIONS

The subject application claims priority to Korean Patent Application No. KR 10-201309118681 filed on Oct. 8, 2013 and Korean Patent Application No. KR 10-2014-0125970 filed on Sep. 22, 2014, the disclosures of which are hereby incorporated in their entirety by reference.

BACKGROUND OF THE INVENTION

Field of the Invention

The present invention relates to a heat pump system for a vehicle, and more particularly, to a heat pump system for a vehicle which delays the change of the direction of a directional valve for a given period of time and then conducts the change of the direction of the directional valve, upon receiving the mode change signal between an air conditioner mode and a heat pump mode, thus preventing the generation of the noise and vibration caused by the differential pressure of a refrigerant.

Background of the Related Art

An air conditioner for a vehicle generally includes a cooling system for cooling the interior of the vehicle and a heating system for heating the interior of the vehicle. The cooling system is configured wherein air passing through the outside of an evaporator at the evaporator side of a refrigerant cycle is heat-exchanged with a refrigerant flowing to the interior of the evaporator and changed to cool air, thus making the interior of the vehicle cooled, and contrarily, the heating system is configured wherein air passing through the outside of a heater core at the heater core side of a cooling water cycle is heat-exchanged with cooling water flowing to the interior of the heater core and changed to hot air, thus making the interior of the vehicle heated.

Unlike the air conditioner for the vehicle, on the other hand, there is proposed a heat pump system which changes the direction of the flow of a refrigerant by using one refrigerant cycle to selectively conduct cooling and heating. For example, the heat pump system includes two heat exchangers (that is, an indoor heat exchanger disposed inside an air conditioner case to conduct heat exchanging between the refrigerant and the air blown to the interior of the vehicle and an outdoor heat exchanger disposed outside the air conditioner case to conduct heat exchanging) and a directional control valve adapted to change the direction of the flow of the refrigerant. If a cooling mode is activated through the change of the direction of the flow of the refrigerant made by the directional control valve, the indoor heat exchanger serves as a cooling heat exchanger, and if a heating mode is activated, the indoor heat exchanger serves as a heating heat exchanger.

Until now, various heat pump systems for a vehicle have been proposed, and one example of such conventional heat pump systems is shown in FIG. 1.

As shown in FIG. 1, the conventional heat pump system for a vehicle includes: a compressor 30 adapted to compress and discharge a refrigerant; an indoor heat exchanger 32 adapted to radiate the refrigerant discharged from the compressor 30; a first expansion valve 34 and a first directional valve 36 disposed in parallel with each other, the first expansion valve 34 being adapted to expand the refrigerant passing through the indoor heat exchanger 32 and the first directional valve 36 being adapted to allow the refrigerant passing through the indoor heat exchanger 32 to selectively flow to the first expansion valve 34; an outdoor heat exchanger 48 adapted to conduct heat exchanging between the refrigerant passing selectively through the first expansion valve 34 and outdoor air; an evaporator 60 adapted to evaporate the refrigerant passing through the outdoor heat exchanger 48; an accumulator 62 adapted to separate the refrigerant passing through the evaporator 60 into vapor refrigerant and liquid refrigerant; an internal heat exchanger 50 adapted to conduct heat exchanging between the refrigerant supplied to the evaporator 60 and the refrigerant returned to the compressor 30; a second expansion valve 56 adapted to selectively expand the refrigerant supplied to the evaporator 60; a bypass line 59 adapted to connect the outlet side of the outdoor heat exchanger 48 and the inlet side of the accumulator 62; and a second directional valve 58 disposed on the branch point of the bypass line 59.

In FIG. 1, a reference numeral 10 indicates an air conditioner case in which the indoor heat exchanger 32 and the evaporator 60 are disposed, 12 indicates a temperature adjusting door adapted to adjust the quantity of cool air and hot air mixed, indicates a blower disposed on the entrance of the air conditioner case, and 37 indicates a bypass line adapted to bypass the first expansion valve 34.

According to the conventional heat pump system for the vehicle under the above-mentioned configuration, if a heat pump mode (heating mode) is activated, the first directional valve 36 is changed in direction to allow the refrigerant to pass through the first expansion valve 34, and the second direction valve 58 is changed in direction to allow the refrigerant to pass through the second expansion valve 56. Further, the temperature adjusting door 12 operates as shown in FIG. 1. Accordingly, the refrigerant discharged from the compressor 30 passes through the indoor heat exchanger 32, the first directional valve 36, the first expansion valve 34, the outdoor heat exchanger 48, a high pressure part 52 of the internal heat exchanger 50, the second directional valve 58, the accumulator 62, and a low pressure part 54 of the internal heat exchanger 50, sequentially and returns to the compressor 30.

If an air conditioner mode (cooling mode) is activated, the first directional valve 36 is changed in direction to allow the refrigerant to bypass the first expansion valve 34, and the second direction valve 58 is changed in direction to allow the refrigerant to pass through the second expansion valve 56. Further, the temperature adjusting door 12 closes the passage of the indoor heat exchanger 32. Accordingly, the refrigerant discharged from the compressor 30 passes through the indoor heat exchanger 32, the first directional valve 36, the outdoor heat exchanger 48, the high pressure part 52 of the internal heat exchanger 50, the second expansion valve 56, the evaporator 60, the accumulator 62, and the low pressure part 54 of the internal heat exchanger 50, sequentially and returns to the compressor 30. That is, the evaporator 60 serves as an evaporator, and the indoor heat exchanger 32 closed by the temperature adjusting door 12 serves as a heater in the same manner as in the heat pump mode.

According to the conventional heat pump system, however, high pressure refrigerant is discharged to a low pressure by means of the differential pressure of the refrigerant upon the change between the heat pump mode and the air conditioner mode, which undesirably causes noise and vibration to be generated.

In the air conditioner mode, that is, the high temperature, high pressure refrigerant flows to the first directional valve 36, the bypass line 37 and the second directional valve 58, and the first expansion valve 34 and the bypass line 59 are in a low pressure. Upon the change from the air condition mode to the heat pump mode, at this time, the first directional valve 36 is changed in direction to allow the high temperature, high pressure refrigerant passing through the indoor heat exchanger 32 to flow to the first expansion valve 34 being in the low pressure, thus generating the noise and vibration due to the differential pressure of the refrigerant. The second directional valve 58 is changed in direction to allow the high temperature, high pressure refrigerant passing through the outdoor heat exchanger 48 to flow to the bypass line 59 being in the low pressure, thus undesirably generating the noise and vibration due to the differential pressure of the refrigerant.

In the heat pump mode, further, high temperature, high pressure refrigerant flows to the first directional valve 36, low temperature, low pressure refrigerant flows to the second directional valve 58, and the bypass line 37 and the second expansion valve 56 are in a low pressure. Upon the change from the air condition mode to the heat pump mode, at this time, the first directional valve 36 is changed in direction to allow the high temperature, high pressure refrigerant passing through the indoor heat exchanger 32 to bypass the first expansion valve 34 and to flow to the bypass line 37 being in the low pressure, thus undesirably generating the noise and vibration due to the differential pressure of the refrigerant.

SUMMARY OF THE INVENTION

Accordingly, the present invention has been made in view of the above-mentioned problems occurring in the prior art, and it is an object of the present invention to provide a heat pump system for a vehicle which delays the change of the direction of a directional valve for a given period of time and then conducts the change of the direction of the directional valve, upon receiving the mode change signal between an air conditioner mode and a heat pump mode, thus preventing the generation of the noise and vibration caused by the differential pressure of a refrigerant.

To accomplish the above-mentioned object, according to the present invention, there is provided a heat pump system for a vehicle including: heat pump cycle components including a compressor 100, an indoor heat exchanger 110, an expansion valve unit 120, an outdoor heat exchanger 130 and an evaporator 160; a refrigerant circulation line R connecting said heat pump cycle components; a bypass line R1 and a second valve unit 191 disposed on the refrigerant circulation line R to allow a refrigerant circulating the refrigerant circulation line R to bypass at least one component among the heat pump cycle components; and a controller adapted to change the direction of the flow of refrigerant through the second valve unit 191 in case a mode change signal to change between an air conditioner mode and a heat pump mode is received, characterized in that: when the mode change signal is received, the controller changes the direction of the second valve unit 191 after a first delay time from the mode change signal receiving time.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
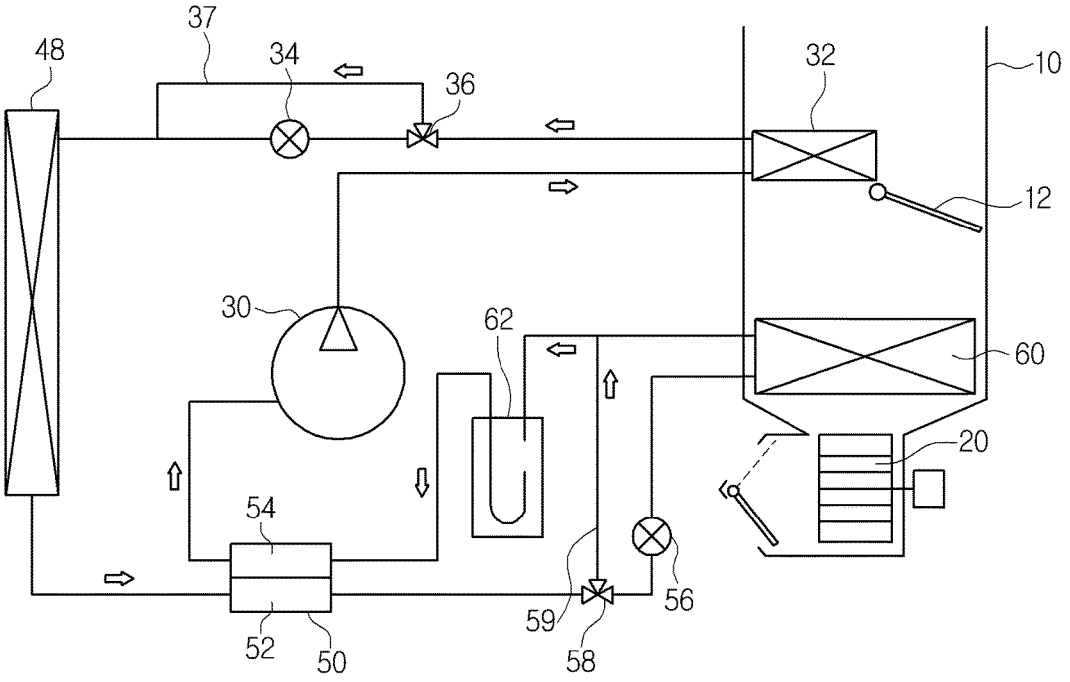
FIG. 1 is a schematic diagram showing a conventional heat pump system for a vehicle.

Hereinafter, an explanation on a heat pump system for a vehicle according to the present invention will be in detail given with reference to the attached drawing.

First, a heat pump system for a vehicle according to the present invention includes: heat pump cycle components including a compressor 100, an indoor heat exchanger 110, an expansion valve unit 120, an outdoor heat exchanger 130 and an evaporator 160; a refrigerant circulation line R connecting said heat pump cycle components; a bypass line R1 and a second valve unit 191 disposed on the refrigerant circulation line R to allow a refrigerant circulating the refrigerant circulation line R to bypass at least one component among the heat pump cycle components; a controller adapted to change the direction of the flow of refrigerant through the second valve unit 191 in case a mode change signal to change between an air conditioner mode and a heat pump mode is received.

In addition to the bypass line R1 adapted to allow the refrigerant to bypass expansion means 140 and the evaporator 160, further, an auxiliary bypass line R2 is disposed on the refrigerant circulation line R to allow the refrigerant to bypass the outdoor heat exchanger 130.

At this time, the second valve unit 191 is disposed on a branch point of the bypass line R1, and a third valve unit 192 on a branch point of the auxiliary bypass line R2.

Figure 2:
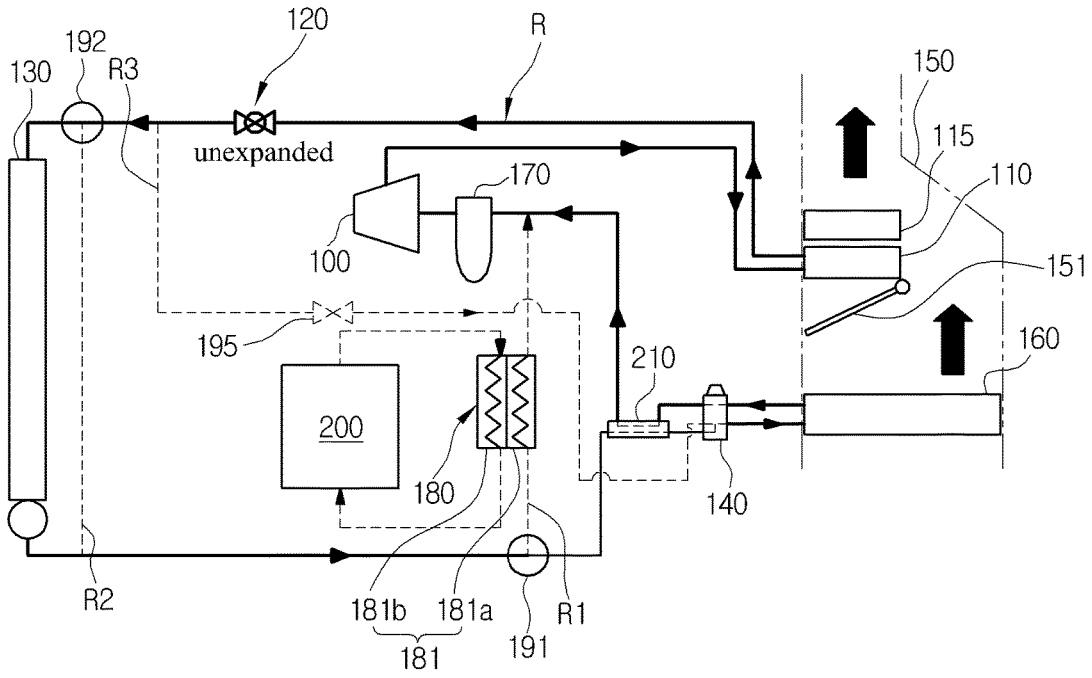
FIG. 2 is a schematic diagram showing an air conditioner mode in a heat pump system for a vehicle according to the present invention.

In the air conditioner mode, as shown in FIG. 2, the refrigerant discharged from the compressor 100 is circulated sequentially along the indoor heat exchanger 110, the first valve unit 120, the outdoor heat exchanger 130, the expansion means 140, the evaporator 160 and the compressor 100, and at this time, the indoor heat exchanger 110 serves as a condenser, the evaporator 160 serves as an evaporator, and the first valve unit 120 is adapted to allow the refrigerant to pass therethrough in the state where the refrigerant is in an unexpanded state.

On the other hand, the outdoor heat exchanger 130 serves as the condenser like the indoor heat exchanger 110.

Figure 3:
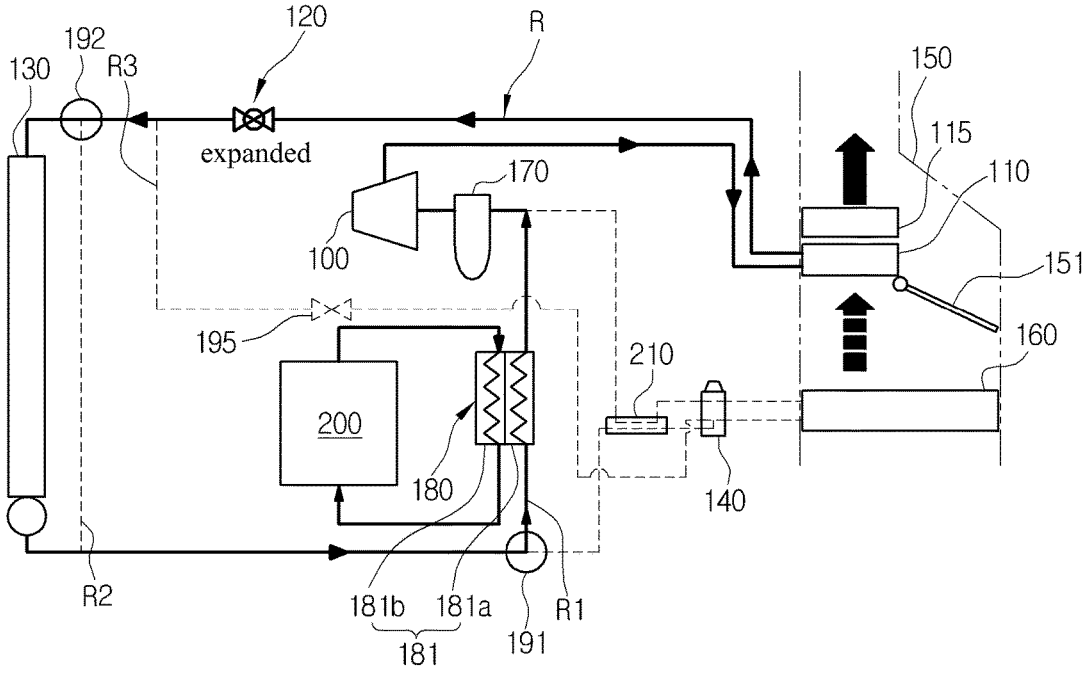
FIG. 3 is a schematic diagram showing a heat pump mode in the heat pump system for a vehicle according to the present invention.

In the heat pump mode, as shown in FIG. 3, the refrigerant discharged from the compressor 100 is circulated sequentially along the indoor heat exchanger 110, an orifice 128 of the first valve unit 120, the outdoor heat exchanger 130, the bypass line R1 and the compressor 100, and at this time, the indoor heat exchanger 110 serves as a condenser, the outdoor heat exchanger 130 serves as an evaporator, the first valve unit 120 expands the refrigerant, and the refrigerant is not supplied to the expansion means 140 and the evaporator 160.

Upon indoor dehumidification during the heat pump mode, on the other hand, a portion of the refrigerant circulating the refrigerant circulation line R is supplied to the evaporator 160 through a dehumidifying line R3 as will be discussed later, thus performing the indoor dehumidification.

Hereinafter, each part of the heat pump system according to the present invention will be in detail explained.

First, the compressor 100, which is disposed on the refrigerant circulation line R, is driven by receiving power from an engine (internal combustion engine) or a motor, absorbs and compresses the refrigerant, and discharges the compressed refrigerant in a form of high temperature, high pressure gas.

In the air conditioner mode, the compressor 100 absorbs and compresses the refrigerant discharged from the evaporator 160 and supplies the compressed refrigerant to the indoor heat exchanger 110, and in the heat pump mode, the compressor 100 absorbs and compresses the refrigerant which is discharged from the outdoor heat exchanger 130 and passes through the bypass line R1 and supplies the compressed refrigerant to the indoor heat exchanger 110.

In the dehumidification mode during the heat pump mode, moreover, the refrigerant is supplied to both of the bypass line R1 and the evaporator 160 through the dehumidifying line R3, and in this case, accordingly, the compressor 100 absorbs and compresses the refrigerant which passes through both of the bypass line R1 and the evaporator 160 and then mixes and supplies the compressed refrigerant to the indoor heat exchanger 110.

The indoor heat exchanger 110, which is disposed inside an air conditioner case 150 and connected to the refrigerant circulation line R at the outlet side of the compressor 100, serves to conduct heat exchanging between the air flowing in the air conditioner case 150 and the refrigerant discharged from the compressor 100.

Further, the evaporator 160, which is disposed inside the air conditioner case 150 and connected to the refrigerant circulation line R at the inlet side of the compressor 100, serves to conduct heat exchanging between the air flowing in the air conditioner case 150 and the refrigerant flowing to the compressor 100.

The indoor heat exchanger 110 serves as a condenser upon both of the air conditioner mode and the heat pump mode.

The evaporator 160 serves as the evaporator upon the air conditioner mode and stops in the heat pump mode because the refrigerant is not supplied thereto. Upon the dehumidification mode, of course, the evaporator 160 serves as the evaporator because a portion of the refrigerant is supplied thereto.

Further, the indoor heat exchanger 110 and the evaporator 160 are spaced apart from each other by a given distance at the inside the air conditioner case 150, and in this case, the evaporator 160 and the indoor heat exchanger 110 are disposed sequentially from the upstream side in the direction of the flow of air in the air conditioner case 150.

Upon the air conditioner mode wherein the evaporator 160 serves as the evaporator, as shown in FIG. 2, the low temperature, low pressure refrigerant discharged from the expansion means 140 is supplied to the evaporator 160, and at this time, the air flowing inside the air conditioner case 150 through a blower (not shown) is heat-exchanged with the low temperature, low pressure refrigerant in the evaporator 160 when passing through the evaporator 160 and thus changed to cool air, so that the cool air is discharged to the interior of the vehicle, thus making the interior of the vehicle cooled.

Upon the heat pump mode wherein the indoor heat exchanger 110 serves as the condenser, as shown in FIG. 3, the high temperature, high pressure refrigerant discharged from the compressor 100 is supplied to the indoor heat exchanger 110, and at this time, the air flowing inside the air conditioner case 150 through the blower is heat-exchanged with the high temperature, high pressure refrigerant in the indoor heat exchanger 110 when passing through the indoor heat exchanger 110 and thus changed to hot air, so that the hot air is discharged to the interior of the vehicle, thus making the interior of the vehicle heated.

Further, a temperature adjusting door 151 is disposed between the evaporator 160 and the indoor heat exchanger 110 inside the air conditioner case 150 to adjust the quantity of air bypassing the indoor heat exchanger 110 and the quantity of air passing through the indoor heat exchanger 110.

Through the adjustment of the quantity of air bypassing the indoor heat exchanger 110 and the quantity of air passing through the indoor heat exchanger 110, the temperature adjusting door 151 appropriately adjusts a temperature of the air discharged from the air conditioner case 150.

Upon the air conditioner mode, at this time, if the passage on the front side of the indoor heat exchanger 110 is completely closed through the temperature adjusting door 151, as shown in FIG. 2, the cool air passing through the evaporator 160 bypasses the indoor heat exchanger 110 and is supplied to the interior of the vehicle, thus conducting maximum cooling. Upon the heat pump mode, if the passage bypassing the indoor heat exchanger 110 is completely closed through the temperature adjusting door 151, as shown in FIG. 3, all of the air passes through the indoor heat exchanger 110 serving as the condenser and is thus changed to hot air, so that the hot air is supplied to the interior of the vehicle, thus conducting maximum heating.

The outdoor heat exchanger 130, which is disposed outside the air conditioner case 150 and connected to the refrigerant circulation line R, serves to conduct heat exchanging between the refrigerant circulating the refrigerant circulation line R and outdoor air.

In this case, the outdoor heat exchanger 130 is disposed at the front side of an engine room of the vehicle to conduct the heat exchanging between the refrigerant circulating the refrigerant circulation line R and the outdoor air.

Upon the air conditioner mode, the outdoor heat exchanger 110 serves as the condenser in the same manner as the indoor heat exchanger 110. At this time, the high temperature refrigerant flowing in the outdoor heat exchanger 130 is heat-exchanged with the outdoor air and thus condensed. Upon the heat pump mode, the outdoor heat exchanger 110 serves as the evaporator unlike the indoor heat exchanger 110, and at this time, the low temperature refrigerant flowing in the outdoor heat exchanger 130 is heat-exchanged with the outdoor air and thus evaporated.

The first valve unit 120 includes an on/off valve 125 disposed on the refrigerant circulation line R between the indoor heat exchanger 110 and the outdoor heat exchanger 130 to perform an opening/closing operation for the flow of the refrigerant and the orifice 128 unitarily formed with the on/off valve 125 to expand the refrigerant, so that upon the air conditioner mode, the first valve unit 120 opens the on/off valve 125 to allow the refrigerant to flow in the state where the refrigerant is in an unexpanded state, and upon the heat pump mode, the first valve unit 120 closes the on/off valve 125 to allow the refrigerant to be expanded through the orifice 128 and thus flow.

That is, the first valve unit 120 has the two-way on/off valve 125 and the orifice 128 formed unitarily therewith, the orifice 128 serving to conduct throttling (expansion).

Figure 5A:
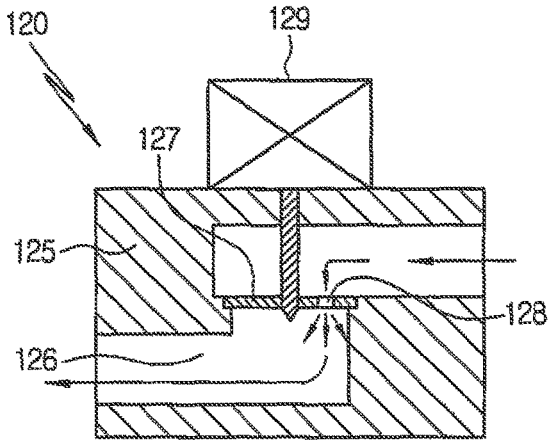
FIGS. 5A and 5B are sectional views showing the opening/closing states of an on/off valve of a first valve unit in the heat pump system for a vehicle according to the present invention.
Figure 5B:
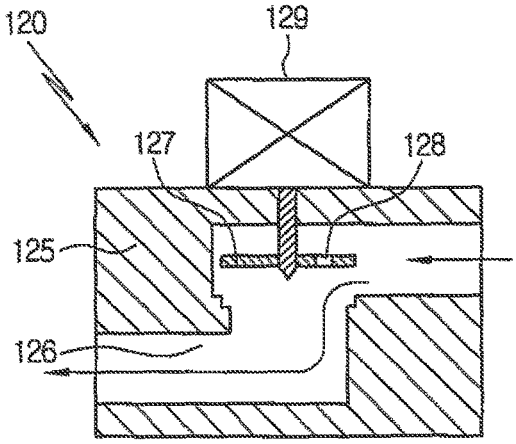

FIGS. 5*a* and 5B show the opening/closing states of the first valve unit 120. A passage 126 is formed inside the on/off valve 125, through which the refrigerant flows, and a valve member 127 is disposed to open and close the passage 126.

At this time, the orifice 128 is formed on the valve member 127 to expand the refrigerant.

Further, a solenoid 129 is mounted on one side of the on/off valve 125 to open and close the valve member 127.

The solenoid 129 linearly reciprocates the valve member 127 to open or close the passage 126.

If the valve member 127 of the first valve unit 120 opens the passage 126, as shown in FIG. 5B, the refrigerant passes through the first valve unit 120, without being expanded, and if the valve member 127 of the first valve unit 120 closes the passage 126, as shown in FIG. 5A, the refrigerant is first expanded through the orifice 128 of the valve member 127 and then passes through the first valve unit 120.

Even though not shown, on the other hand, a motor instead of the solenoid 129 may be disposed to operate the valve member 127 of the on/off valve 125.

That is, the motor is mounted on one side of the on/off valve 125 to rotate the valve member 127.

The solenoid 129 linearly reciprocates the valve member 127 to open and close the passage 126, but the motor rotates the valve member 127 to open and close the passage 126.

The bypass line R1 connects the refrigerant circulation line R at the outlet side of the outdoor heat exchanger 130 and the refrigerant circulation line R at the inlet side of the compressor 100 to allow the refrigerant circulating the refrigerant circulation line R to selectively bypass the expansion means 140 and the evaporator 160.

As shown, the bypass line R1 is disposed in parallel with the expansion means 140 and the evaporator 160. That is, the inlet side of the bypass line R1 is connected to the refrigerant circulation line R connecting the outdoor heat exchanger 130 and the expansion means 140 and the outlet side thereof is connected to the refrigerant circulation line R connecting the evaporator 160 and the compressor 100.

Upon the air conditioner mode, accordingly, the refrigerant passing through the outdoor heat exchanger 130 flows to the expansion means 140 and the evaporator 160, but upon the heat pump mode, the refrigerant passing through the outdoor heat exchanger 130 flows just to the compressor 100 through the bypass line R1, while bypassing the expansion means 140 and the evaporator 160.

In this case, the change in the direction of the flow of the refrigerant according to the air conditioner mode and the heat pump mode is performed by means of the second valve unit 191.

The second valve unit 191, which is disposed on the branch point between the bypass line R1 and the refrigerant circulation line R, changes the direction of the flow of the refrigerant passing through the outdoor heat exchanger 130 to allow the refrigerant to flow to the bypass line R1 or the expansion means 140 according to the air conditioner mode or the heat pump mode.

Upon the air conditioner mode, the second valve 191 changes the direction of the flow of the refrigerant discharged from the compressor 100 and passing sequentially through the indoor heat exchanger 110, the first valve unit 120 and the outdoor heat exchanger 130 to allow the refrigerant to flow to the expansion means 140 and the evaporator 160, and upon the heat pump mode, the second valve 191 changes the direction of the flow of the refrigerant discharged from the compressor 100 and passing sequentially through the indoor heat exchanger 110, the orifice 128 of the first valve unit 120 and the outdoor heat exchanger 130 to allow the refrigerant to flow to the bypass line R1.

On the other hand, the second valve unit 191 is mounted on the branch point of the inlet side of the bypass line R1 and desirably formed of a three-way valve.

A third valve unit 192 is formed of a three-way valve, as well.

Further, heat supply means 180 is mounted on the bypass line R1 to supply heat to the refrigerant flowing along the bypass line R1.

The heat supply means 180, which supplies the waste heat of an electric assembly 200 to the refrigerant flowing along the bypass line R1, includes a water cooled heat exchanger 181 having a refrigerant heat exchanging part 181*a* to which the refrigerant flowing along the bypass line R1 flows and a cooling water heat exchanging part 181*b* disposed on one side of the refrigerant heat exchanging part 181*a* to allow the cooling water circulating the electric assembly 200 to flow thereto.

Upon the heat pump mode, accordingly, the heat source is collected from the waste heat of the electric assembly 200, thus improving the heating performance of the system.

On the other hand, the electric assembly 200 generally includes a motor, an inverter and the like.

Further, an accumulator 170 is disposed on the refrigerant circulation line R at the inlet side of the compressor 100.

The accumulator 170 separates liquid refrigerant and vapor refrigerant from the refrigerant supplied from the compressor 100 to supply only the vapor refrigerant to the compressor 100.

Further, an electric heater 115 is disposed on the downstream side from the indoor heat exchanger 110 inside the air conditioner case 150 to improve the heating performance.

That is, the electric heater 115, as an auxiliary heat source at the initial step of starting of the vehicle, operates to improve the heating performance, and if the heat source for heating is needed, further, the electric heater 115 may be activated.

The electric heater 115 is desirably formed of a PTC (positive temperature coefficient) heater.

The auxiliary bypass line R2 is disposed in the parallel with the refrigerant circulation line R to allow the refrigerant passing through the first valve unit 120 to bypass the outdoor heat exchanger 130.

The auxiliary bypass line R2 connects the refrigerant circulation line R at the inlet side of the outdoor heat exchanger 130 and the refrigerant circulation line R at the outlet side thereof to allow the refrigerant circulating the refrigerant circulation line R to bypass the outdoor heat exchanger 130.

In this case, the change in the direction of the flow of the refrigerant is performed by means of the third valve unit 192 to allow the refrigerant circulating the refrigerant circulation line R to selectively flow along the auxiliary bypass line R2.

The third valve unit 192, which is disposed on the branch point between the auxiliary bypass line R2 and the refrigerant circulation line R, changes the direction of the flow of the refrigerant to allow the refrigerant to flow to the outdoor heat exchanger 130 or the auxiliary bypass line R2.

At this time, if frosting occurs on the outdoor heat exchanger 130 or an outdoor air temperature is less than 0° C., the outdoor heat exchanger 130 does not absorb heat from the outdoor air gently, so that the third valve unit 192 allows the refrigerant circulating the refrigerant circulation line R to bypass the outdoor heat exchanger 130.

On the other hand, only if the heat exchanging efficiency between the outdoor air and the refrigerant flowing to the outdoor heat exchanger 130 is good irrespective of the outdoor air temperature of 0° C., the refrigerant flows to the outdoor heat exchanger 130, and contrarily, if the heat exchanging efficiency therebetween is not good, the refrigerant bypasses the outdoor heat exchanger 130, thus improving the heating performance and efficiency of the system.

When the frosting occurs on the outdoor heat exchanger 130, further, the refrigerant flows to the auxiliary bypass line R2 and bypasses the outdoor heat exchanger 130, so that the frosting is delayed or removed.

Further, the dehumidifying line R3 is disposed on the refrigerant circulation line R to supply a portion of the refrigerant circulating the refrigerant circulation line R to the evaporator 160, so that the dehumidification for the interior of the vehicle is conducted in the heat pump mode.

At this time, low temperature refrigerant should be supplied to the evaporator 160 to dehumidify the interior of the vehicle, and accordingly, the dehumidifying line R3 is connected to a section of the refrigerant circulation line R in which the low temperature refrigerant is circulated.

In more detail, the dehumidifying line R3 supplies a portion of the low temperature refrigerant passing through the orifice 128 of the first valve unit 120 to the evaporator 160.

That is, the dehumidifying line R3 connects the refrigerant circulation line R at the outlet side of the first valve unit 120 and the refrigerant circulation line R at the inlet side of the evaporator 160.

As shown, the inlet of the dehumidifying line R3 is connected to the refrigerant circulation line R between the first valve unit 120 and the outdoor heat exchanger 130, so that a portion of the refrigerant passing through the first valve unit 120, before flowing to the outdoor heat exchanger 130, flows to the dehumidifying line R3 and is supplied to the evaporator 160.

Further, an on/off valve 195 is mounted on the dehumidifying line R3 to open/close the dehumidifying line R3 only in the dehumidification mode for the interior of the vehicle, thus allowing a portion of the refrigerant passing through the first valve unit 120 to flow to the dehumidifying line R3.

The on/off valve 195 opens the dehumidifying line R3 only in the dehumidification mode and closes the dehumidifying line R3 if the dehumidification mode is not set.

Upon the dehumidification mode, accordingly, if the on/off valve 195 is open, a portion of the refrigerant passing through the orifice 128 of the first valve unit 120 flows to the evaporator 160 through the dehumidifying line R3, thus gently conducting the dehumidification for the interior of the vehicle.

The outlet of the dehumidifying line R3 is connected to the expansion means 140, but at this time, the refrigerant passing through the dehumidifying line R3 is not expanded in the expansion means 140, but flows to the evaporator 160.

Figure 6:
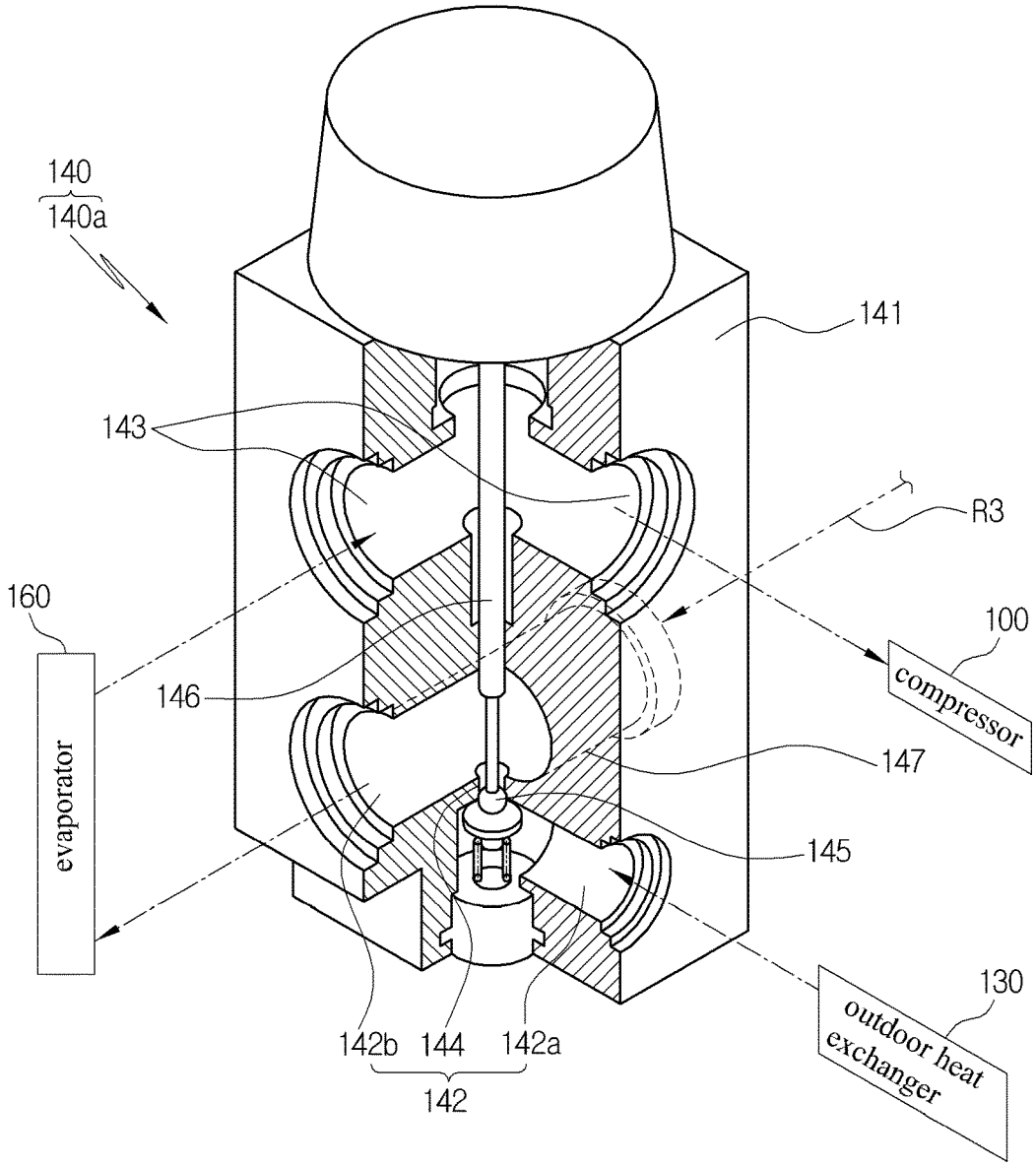
FIG. 6 is a sectional perspective view showing expansion means in the heat pump system for a vehicle according to the present invention.

That is, as shown in FIG. 6, the expansion means 140 is formed of an expansion valve 140*a* having an expansion passage 144 adapted to expand the refrigerant and a bypass passage 147 adapted to allow the refrigerant to bypass the expansion passage 144.

At this time, the outlet of the dehumidifying line R3 is connected to the bypass passage 147 of the expansion valve 140*a* to allow the refrigerant passing through the dehumidifying line R3 to bypass the expansion passage 144 through the bypass passage 147 and to supply the refrigerant to the evaporator 160.

Referring briefly to FIG. 6, the expansion means 140 includes: a body 141 having a first passage 142 having the expansion passage 144 formed between an inlet 142*a* and an outlet 142*b* and a second passage 143 along which the refrigerant discharged from the evaporator 160 flows; a valve body 145 disposed inside the body 141 to adjust the degree of opening of the expansion passage 144 so that a quantity of flow of the refrigerant passing through the expansion passage 144 is adjusted; and a rod 146 disposed ascended and descended inside the body 141 to elevate the valve body 145 according to the temperature changes of the refrigerant at the outlet side of the evaporator 160 flowing along the second passage 143.

Further, a diaphragm (not shown) is disposed on the top end portion of the body 141 in such a manner as to be displaced according to the temperature changes of the refrigerant flowing along the second passage 143. Accordingly, the rod 146 is ascended and descended according to the displacement of the diaphragm, thus operating the valve body 145.

The bypass passage 147 is formed inside the body 141 in such a manner as to communicate with the outlet 142*b* of the first passage 142 on the downstream side in the direction of the flow of the refrigerant.

Accordingly, the refrigerant passing through the dehumidifying line R3 bypasses the expansion passage 144 of the expansion means 140 through the bypass passage 147 and is then supplied just to the evaporator 160.

On the other hand, the outlet of the dehumidifying line R3 is inserted into the bypass passage 147 of the expansion means 140, so that the dehumidifying line R3 can be conveniently assembled and connected simply, thus reducing the number of parts and the weight thereof.

Further, a double pipe heat exchanger 210 is disposed to conduct the heat exchanging between the refrigerant before flowing to the expansion means 140 after discharged from the outdoor heat exchanger 130 and the refrigerant discharged from the evaporator 160.

As shown, the double pipe heat exchanger 210 is not schematically shown, and briefly, it has a double pipe structure having an inner pipe and an outer pipe.

At this time, the inner pipe is connected to the refrigerant circulation line R at the inlet side of the expansion means 140, and the outer pipe to the refrigerant circulation line R at the outlet side of the evaporator 160. Of course, they are connected vice versa.

Accordingly, the high temperature refrigerant discharged from the outdoor heat exchanger 130 is heat-exchanged with the low temperature refrigerant discharged from the evaporator 160 to allow the temperature of the refrigerant flowing to the expansion means 140 to be lowered, thus improving the cooling performance, and further, the liquid refrigerant contained in the refrigerant discharged from the evaporator 160 is evaporated to prevent the introduction into the compressor 100.

According to the present invention, further, the controller is provided to change the direction of the flow of the refrigerant through the second valve unit 191 if the air conditioner mode and the heat pump mode are changed to each other.

That is, when the mode change signal is received by automatic control or manual control of a passenger, the controller changes the direction of the second valve unit 191 to conduct the change between the air conditioner mode and the heat pump mode.

At this time, the controller first delays the change in the direction of the second valve unit 191 for a given period of time upon receiving the mode change signal between the air conditioner mode and the heat pump mode and then conducts the change of the direction of the second valve unit 191.

That is, if the air conditioner mode and the heat pump mode are changed to each other, the controller does not conduct just the change of the direction of the second valve unit 191, and after delaying the change in the direction of the second valve unit 191 for a given period of time, it conducts the change of the direction of the second valve unit 191.

The delay of the change in the direction of the second valve unit 191 for the given period of time upon receiving the mode change signal between the air conditioner mode and the heat pump mode allows the refrigerant circulating the refrigerant circulation line R to be reduced under a given pressure, and at this time, if the pressure of the refrigerant is reduced, the pressures at the high pressure side and the low pressure side on the refrigerant circulation line R can be balanced.

Upon receiving the mode change signal between the air conditioner mode and the heat pump mode, like this, the change in the direction of the second valve unit 191 for the given period of time is delayed to reduce the refrigerant circulating the refrigerant circulation line R under the given pressure, and next, the change of the direction of the second valve unit 191 is conducted, thus preventing the noise and vibration caused by the differential pressure of the refrigerant from being generated.

Upon receiving the mode change signal between the air conditioner mode and the heat pump mode, further, the controller delays the opening/closing operation of the on/off valve 125 for a given period of time as well as the change of the direction of the second valve unit 191.

Upon receiving the mode change signal between the air conditioner mode and the heat pump mode, that is, the controller conducts the change of the direction of the second valve unit 191 and the opening/closing operation of the on/off valve 125, and so as to prevent the generation of the noise and vibration caused by the differential pressure of the refrigerant, at this time, the change of the direction of the second valve unit 191 and the opening/closing operation of the on/off valve 125 are delayed for a given period of time.

Upon receiving the mode change signal between the air conditioner mode and the heat pump mode, further, the controller first turns off the compressor 100 and then delays the change of the direction of the second valve unit 191 and the opening/closing operation of the on/off valve 125 for the given period of time.

That is, the compressor 100 is first turned off, and next, the change of the direction of the second valve unit 191 and the opening/closing operation of the on/off valve 125 are delayed for the given period of time, so that the delay of the second valve unit 191 and the on/off valve 125 allows the refrigerant circulating the refrigerant circulation line R to be reduced under the given pressure.

At this time, after the pressure of the refrigerant is under 10 kgf/cm$^2$, the change of the direction of the second valve unit 191 and the opening/closing operation of the on/off valve 125 are desirably conducted.

Upon receiving the mode change signal between the air conditioner mode and the heat pump mode, it is desirable that the heat pump mode is changed to the air conditioner mode.

On the other hand, a cooling water line (to which no reference numeral is assigned) is connected to the heat supply means 180 to supply the electric assembly waste heat to the heat supply means 180, and a cooling water change valve (not shown) is mounted on the cooling water line. The controller turns off the cooling water change valve when first turns off the compressor 100.

Figure 7:
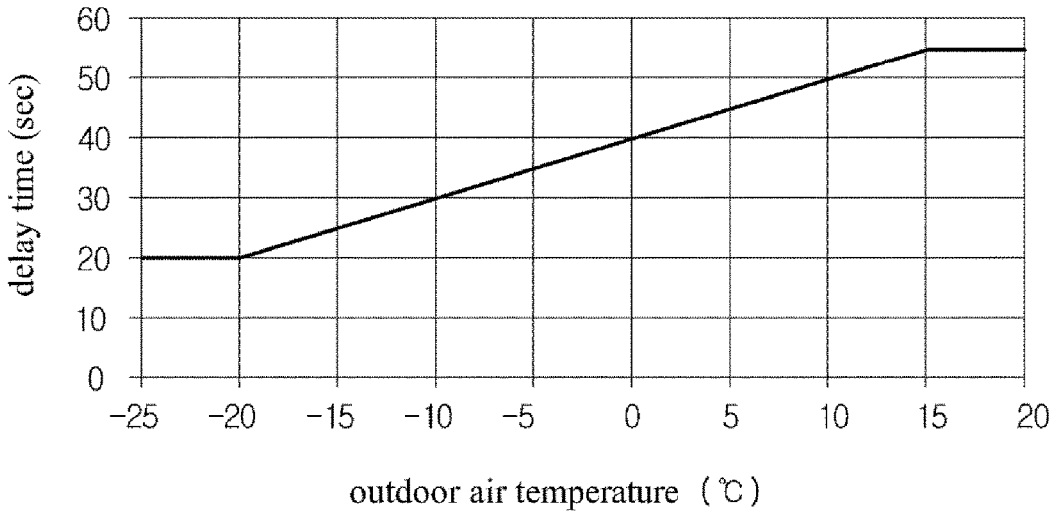
FIG. 7 is a graph showing delay time according to outdoor air temperature in the heat pump system for a vehicle according to the present invention.

Further, as shown in FIG. 7, the delay time for the change of the direction of the second valve unit 191 and the opening/closing operation of the on/off valve 125 is increased and decreased in proportion to the temperature of outdoor air.

Referring to FIG. 7, the lower the temperature of outdoor air is, the shorter the delay time is, and contrarily, the higher the temperature of outdoor air is, the longer the delay time is. That is, as the temperature of outdoor air is low, the pressure balance at the high pressure side and the low pressure side on the refrigerant circulation line R can be rapidly obtained.

The delay time according to temperature of outdoor air, as shown in FIG. 7, is applied desirably when the heat pump mode is changed to the air conditioner mode.

On the other hand, if the valve member 127 of the on/off valve 125 is open and closed by means of the motor, the controller reduces the rotating speed of the valve member 127 upon receiving the mode change signal between the air conditioner mode and the heat pump mode so as to delay the opening/closing operation of the valve member 127 for a given period of time.

Next, the controller sequentially conducts the change of the direction of the second valve unit 191 and the opening/closing operation of the on/off valve 125, having given time difference therebetween.

Upon receiving the mode change signal between the air conditioner mode and the heat pump mode, desirably, upon the change from the air conditioner mode to the heat pump mode, the controller first turns off the compressor 100, changes the direction of the second valve unit 191 after the delay for 10 seconds, performs the opening/closing operation of the on/off valve 125 after the delay for one second, and turns on the compressor 100 after one second.

In the air conditioner mode, that is, the refrigerant does not flow to the bypass line R1, so that the bypass line R1 is in a state of a low pressure, and upon receiving the mode change signal to the heat pump mode, accordingly, if the second valve unit 191 is changed immediately in direction, that is, if the flowing direction of the refrigerant toward the expansion means 140 is changed immediately to the bypass line R1, the high pressure refrigerant flows to the low pressure side to undesirably cause noise and vibration to be generated by the differential pressure of the refrigerant and to further make the durability of the water cooled heat exchanger 181 for low pressure deteriorated.

Further, the pressures of the refrigerants on the second valve unit 191 and the first valve unit 120 on the refrigerant circulation line R are different from each other, and at this time, the pressure difference upon the change of the direction of the second valve unit 191 is relatively smaller than that upon the opening/closing operation of the on/off valve 125, so that upon receiving the mode change signal from the air conditioner mode to the heat pump mode, the controller first turns off the compressor 100, changes the direction of the second valve unit 191 after the delay for 10 seconds, and performs the opening/closing operation of the on/off valve 125 after the delay for one second.

On the refrigerant circulation line R, that is, the delay time for the on/off valve 125 on which the pressure difference is relatively higher than that on the second valve unit 191 becomes longer than that for the second valve unit 191.

Upon receiving the mode change signal from the air conditioner mode to the heat pump mode, further, after the delay for the given period of time (10 seconds) irrespective of the temperature of outdoor air, the change of the direction of the second valve unit 191 and the opening/closing operation of the on/off valve 125 are conducted sequentially, having given time difference therebetween.

On the other hand, after the change of the direction of the second valve unit 191 and the opening/closing operation of the on/off valve 125 have been conducted, the controller turns on the compressor 100 again.

Next, when the vehicle is keyed off or the heat pump system is turned off during the operation of the air conditioner mode and then the vehicle is keyed on or the heat pump system is turned on again and the controller receives the mode change signal to the heat pump mode, the controller counts the delay time (10 seconds) from the time point when the vehicle is keyed off or the heat pump system is turned off.

That is, when the vehicle is keyed off or the heat pump system is turned off, the compressor 100 is also turned off, so that the delay time is operated from that time point.

Also, when the vehicle is keyed off or the heat pump system is turned off during the operation of the heat pump mode and then the vehicle is keyed on or the heat pump system is turned on again and the controller receives the mode change signal to the air conditioner mode, the controller counts the delay time from the time point when the vehicle is keyed off or the heat pump system is turned off.

On the other hand, when the vehicle is keyed off or when the heat pump system is turned on again after turned off during the operation of the heat pump mode, if the vehicle is under the condition of the heat pump mode, not under the condition of the air conditioner mode, restarting (the vehicle is keyed on or the heat pump system is turned on) is conducted before the change of the direction of the second valve unit 191 to allow the vehicle to be operated to the existing mode.

Hereinafter, an operation of the heat pump system for a vehicle according to the present invention will be explained.

In the air conditioner mode (cooling mode), as shown in FIG. 2, the auxiliary bypass line R2 is closed by means of the third valve unit 192, and the bypass line R1 is closed by means of the second valve unit 191. Further, the first valve unit 120 opens the on/off valve 125.

In addition, the cooling water circulating the electric assembly 200 is not supplied to the water cooled heat exchanger 181 of the heat supply means 180.

Upon the maximum cooling, on the other hand, the temperature adjusting door 151 disposed inside the air conditioner case 150 operates to close the passage passing through the indoor heat exchanger 110, so that the air blowing to the air conditioner case 150 by means of the blower passes through the evaporator 160 and is then cooled, and after that, the cooled air bypasses the indoor heat exchanger 110 and is supplied to the interior of the vehicle, thus making the interior of the vehicle cooled.

Referring continuously to the refrigeration circulation process, the high temperature, high pressure vapor refrigerant compressed and discharged from the compressor 100 is supplied to the indoor heat exchanger 110 disposed inside the air conditioner case 150.

Since the temperature adjusting door 151 closes the passage on the indoor heat exchanger 110 side as shown in FIG. 2, the refrigerant supplied to the indoor heat exchanger 110 passes just through the first valve unit 120, without being heat-exchanged with the air, and then flows to the outdoor heat exchanger 130.

The refrigerant flowing to the outdoor heat exchanger 130 is heat-exchanged with the outdoor air and then condensed, so that the vapor refrigerant is changed to liquid refrigerant.

On the other hand, the indoor heat exchanger 110 and the outdoor heat exchanger 130 serve as the condenser, but the refrigerant is mainly condensed in the outdoor heat exchanger 130 wherein it is heat-exchanged with the outdoor air.

The refrigerant passing through the outdoor heat exchanger 130 is reduced in pressure and expanded through the expansion means 140 and becomes the low temperature, low pressure liquid refrigerant. After that, the liquid refrigerant flows to the evaporator 160.

The refrigerant flowing to the evaporator 160 is heat-exchanged with the air blowing to the interior of the air conditioner case 150 through the blower and then evaporated. At the same time, the air is cooled by means of the heat absorption occurring by the latent heat of the evaporation. Accordingly, the cooled air is supplied to the interior of the vehicle, thus making the interior of the vehicle cooled.

After that, the refrigerant discharged from the evaporator 160 is introduced into the compressor 100, and the above-mentioned cycle is circulated again.

In the heat pump mode, as shown in FIG. 3, the auxiliary bypass line R2 is closed by means of the third valve unit 192, and the bypass line R1 is open by means of the second valve unit 191. Accordingly, the refrigerant is not supplied to the expansion means 140 and the evaporator 160.

Further, the on/off valve 125 of the first valve unit 120 is closed to conduct the expansion of the refrigerant through the orifice 128.

On the other hand, the cooling water heated by the electric assembly 200 is supplied to the cooling water heat exchanger 181*b* of the water cooled heat exchanger 181 of the heat supply means 180.

Upon the heat pump mode, the temperature adjusting door 151 disposed inside the air conditioner case 150 operates to close the passage bypassing the indoor heat exchanger 110, so that the air blowing to the air conditioner case 150 by means of the blower passes through the evaporator 160 (whose operation stops) and the indoor heat exchanger 110 and is changed to hot air, and after that, the hot air is supplied to the interior of the vehicle, thus making the interior of the vehicle heated.

Referring continuously to the refrigeration circulation process, the high temperature, high pressure vapor refrigerant compressed and discharged from the compressor 100 is introduced into the indoor heat exchanger 110 disposed inside the air conditioner case 150.

The high temperature, high pressure vapor refrigerant introduced into the indoor heat exchanger 110 is heat-exchanged with the air blowing into the air conditioner case 150 by means of the blower and then condensed. At this time, the air passing through the indoor heat exchanger 110 is changed to the hot air, and the hot air is supplied to the interior of the vehicle, thus making the interior of the vehicle heated.

Next, the refrigerant discharged from the indoor heat exchanger 110 is reduced in pressure and expanded through the orifice 128 and becomes the low temperature, low pressure liquid refrigerant. After that, the liquid refrigerant is supplied to the outdoor heat exchanger 130 serving as the evaporator.

The refrigerant supplied to the outdoor heat exchanger 130 is heat-exchanged with the outdoor air and then evaporated. After that, the refrigerant passes through the bypass line R1 by means of the second valve unit 191, and at this time, the refrigerant passing through the bypass line R1 is heat-exchanged with the cooling water passing through the cooling water heat exchanger 181*b* in the process of passing through the refrigerant heat exchanger 181*a* of the water cooled heat exchanger 181 to collect the waste heat of the electric assembly 200. Next, the refrigerant is introduced into the compressor 100, and the above-mentioned cycle is circulated again.

Figure 4:
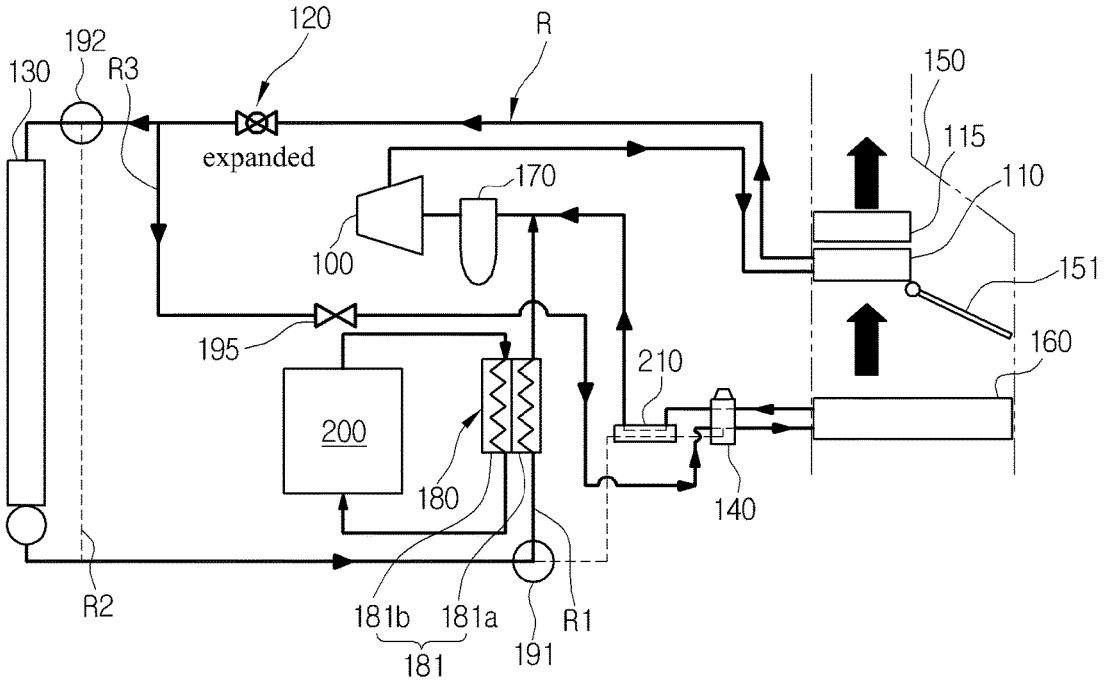
FIG. 4 is a schematic diagram showing a dehumidifying mode during the heat pump mode in the heat pump system for a vehicle according to the present invention.

Upon the dehumidification mode during the heat pump mode, as shown in FIG. 4, the dehumidification mode is operated if the dehumidification for the interior of the vehicle is needed during the heat pump mode as shown in FIG. 3.

Accordingly, an explanation on the operations different from those in the heat pump mode of FIG. 3 will be given.

Upon the dehumidification mode, the dehumidifying line R3 is additionally open through the on/off valve 195 in the heat pump mode.

Upon the dehumidification mode, the temperature adjusting door 151 disposed inside the air conditioner case 150 operates to close the passage bypassing the indoor heat exchanger 110, so that the air blowing to the air conditioner case 150 by means of the blower passes through the evaporator 160 and is then cooled, and after that, the cooled air passes through the indoor heat exchanger 110 and is then changed to hot air. Accordingly, the hot air is supplied to the interior of the vehicle, thus making the interior of the vehicle heated.

At this time, the quantity of refrigerant supplied to the evaporator 160 is small to make air cooling performance low, so that the change in the indoor temperature can be minimized to allow the air passing through the evaporator 160 to be gently dehumidified.

Referring continuously to the refrigeration circulation process, a portion of the refrigerant passing through the compressor 100, the indoor heat exchanger 110 and the orifice 128 of the first valve unit 120 passes through the outdoor heat exchanger 130 and the dehumidifying line R3, respectively.

The refrigerant passing through the outdoor heat exchanger 130 is heat-exchanged with the outdoor air and then evaporated. After that, the refrigerant passes through the bypass line R1 by means of the second valve unit 191, and at this time, the refrigerant passing through the bypass line R1 is heat-exchanged with the cooling water passing through the cooling water heat exchanger 181*b* in the process of passing through the refrigerant heat exchanger 181*a* of the water cooled heat exchanger 181 to collect the waste heat of the electric assembly 200. Next, the refrigerant is evaporated, and on the other hand, the refrigerant passing through the dehumidifying line R3 is supplied to the evaporator 160 and evaporated through the heat-exchanging with the air flowing to the interior of the air conditioner case 150.

The dehumidification is conducted for the air passing through the evaporator 160, and the dehumidified air through the evaporator 160 passes through the indoor heat exchanger 110 and is then changed to the hot air. Next, the hot air is supplied to the interior of the vehicle, thus making the interior of the vehicle dehumidified and heated.

After that, the refrigerant passing through the water cooled heat exchanger 181 and the evaporator 180, respectively is collected and introduced into the compressor 100, and the above-mentioned cycle is circulated again.

As described above, the heat pump system for the vehicle according to the present invention delays the change of the direction of the directional valve for the given period of time and then conducts the change of the direction of the directional valve, upon the change between an air conditioner mode and a heat pump mode, thus preventing the generation of the noise and vibration caused by the differential pressure of the refrigerant.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat pump system for a vehicle comprising:

heat pump cycle components including a compressor, an indoor heat exchanger, an expansion valve unit, an outdoor heat exchanger and an evaporator;

a refrigerant circulation line R connecting said heat pump cycle components;

a bypass line and a second valve unit disposed on the refrigerant circulation line to allow a refrigerant circulating the refrigerant circulation line to bypass at least one component among the heat pump cycle components; and a controller adapted to change the direction of the flow of refrigerant through the second valve unit in case a mode change signal to change between an air conditioner mode and a heat pump mode is received, characterized in that:

when the mode change signal is received, the controller changes the direction of the second valve unit after a first delay time from the mode change signal receiving time;

wherein the expansion valve unit comprises an on/off valve disposed on the refrigerant circulation line between the indoor heat exchanger and the outdoor heat exchanger to perform an opening/closing operation for the flow of the refrigerant and an orifice integrally formed with the on/off valve to expand the refrigerant, so that upon the air conditioner mode, the expansion valve unit opens the on/off valve to allow the refrigerant to flow therethrough in a state where the refrigerant is in an unexpanded state, and upon the heat pump mode, the expansion valve unit closes the on/off valve to allow the refrigerant to be expanded through the orifice and thus flow therethrough;

wherein upon receiving the mode change signal, the controller delays the opening/closing operation of the on/off valve for a second delay time and then conducts the opening/closing operation.

2. The heat pump system according to claim 1, wherein upon receiving the mode change signal, the controller first turns off the compressor and then delays the change of the direction of the second valve unit for the first delay time and the opening/closing operation of the on/off valve for the second delay time.

3. The heat pump system according to claim 2, wherein the first delay time is different from the second delay time so that the controller sequentially conducts the change of the direction of the second valve unit and the opening/closing operation of the on/off valve.

4. The heat pump system according to claim 2, wherein the mode change signal is for changing the heat pump mode to the air conditioner mode.

5. The heat pump system according to claim 3, wherein the mode change signal is for changing the air conditioner mode to the heat pump mode.

6. The heat pump system according to claim 2, wherein the controller turns on the compressor again after conducting the change of the direction of the second valve unit and the opening/closing operation of the on/off valve.

7. The heat pump system according to claim 1, wherein the first delay time is increased or decreased in proportion to the temperature of outdoor air.

8. The heat pump system according to claim 1, wherein the bypass line connects the refrigerant circulation line at the outlet side of the outdoor heat exchanger and the refrigerant circulation line at the inlet side of the compressor, and the second valve unit is disposed on a branch point of the bypass line and the refrigerant circulation line.

9. The heat pump system according to claim 1, wherein when the vehicle is keyed off or the heat pump system is turned off during the operation of the air conditioner mode and then the vehicle is keyed on or the heat pump system is turned on again and the controller receives the mode change signal to the heat pump mode, the controller counts the first delay time from the time point when the vehicle is keyed off or the heat pump system is turned off.

10. The heat pump system according to claim 1, wherein when the vehicle is keyed off or the heat pump system is turned off during the operation of the air conditioner mode and then the vehicle is keyed on or the heat pump system is turned on again and the controller receives the mode change signal to the heat pump mode, the controller counts the second delay time from the time point when the vehicle is keyed off or the heat pump system is turned off.

11. The heat pump system according to claim 1, wherein when the vehicle is keyed off or the heat pump system is turned off during the operation of the heat pump mode and then the vehicle is keyed on or the heat pump system is turned on again and the controller receives the mode change signal to the air conditioner mode, the controller counts the first delay time from the time point when the vehicle is keyed off or the heat pump system is turned off.

12. The heat pump system according to claim 1, wherein when the vehicle is keyed off or the heat pump system is turned off during the operation of the heat pump mode and then the vehicle is keyed on or the heat pump system is turned on again and the controller receives the mode change signal to the air conditioner mode, the controller counts the second delay time from the time point when the vehicle is keyed off or the heat pump system is turned off.

13. The heat pump system according to claim 1, wherein the on/off valve is adapted to open and close a refrigerant passage formed at the inside thereof and has a valve member on which the orifice is formed and a solenoid mounted on one side thereof to operate the valve member.

14. The heat pump system according to claim 1, wherein the on/off valve is adapted to open and close a refrigerant passage formed at the inside thereof and has a valve member on which the orifice is formed and a motor mounted on one side thereof to rotate the valve member.

15. The heat pump system according to claim 14, wherein upon receiving the mode change signal, the controller controls the rotating speed of the valve member so as to delay the opening/closing operation of the valve member.

16. A heat pump system for a vehicle comprising:

heat pump cycle components including a compressor, an indoor heat exchanger, an expansion valve unit, an outdoor heat exchanger and an evaporator;

a refrigerant circulation line R connecting said heat pump cycle components;

a bypass line and a second valve unit disposed on the refrigerant circulation line to allow a refrigerant circulating the refrigerant circulation line to bypass at least one component among the heat pump cycle components; and a controller adapted to change the direction of the flow of refrigerant through the second valve unit in case a mode change signal to change between an air conditioner mode and a heat pump mode is received, characterized in that:

when the mode change signal is received, the controller changes the direction of the second valve unit after a first delay time from the mode change signal receiving time;

wherein the expansion valve unit comprises an on/off valve disposed on the refrigerant circulation line between the indoor heat exchanger and the outdoor heat exchanger to perform an opening/closing operation for the flow of the refrigerant and an orifice integrally formed with the on/off valve to expand the refrigerant, so that upon the air conditioner mode, the expansion valve unit opens the on/off valve to allow the refrigerant to flow therethrough in a state where the refrigerant is in an unexpanded state, and upon the heat pump mode, the expansion valve unit closes the on/off valve to allow the refrigerant to be expanded through the orifice and thus flow therethrough;

wherein the on/off valve is adapted to open and close a refrigerant passage formed at the inside thereof and has a valve member on which the orifice is formed and a solenoid mounted on one side thereof to operate the valve member; and wherein upon receiving the mode change signal, the controller delays the opening/closing operation of the on/off valve for a second delay time and then conducts the opening/closing operation.

17. A heat pump system for a vehicle comprising:

heat pump cycle components including a compressor, an indoor heat exchanger, an expansion valve unit, an outdoor heat exchanger and an evaporator;

a refrigerant circulation line R connecting said heat pump cycle components;

a bypass line and a second valve unit disposed on the refrigerant circulation line to allow a refrigerant circulating the refrigerant circulation line to bypass at least one component among the heat pump cycle components; and a controller adapted to change the direction of the flow of refrigerant through the second valve unit in case a mode change signal to change between an air conditioner mode and a heat pump mode is received, characterized in that:

when the mode change signal is received, the controller changes the direction of the second valve unit after a first delay time from the mode change signal receiving time;

wherein the expansion valve unit comprises an on/off valve disposed on the refrigerant circulation line between the indoor heat exchanger and the outdoor heat exchanger to perform an opening/closing operation for the flow of the refrigerant and an orifice integrally formed with the on/off valve to expand the refrigerant, so that upon the air conditioner mode, the expansion valve unit opens the on/off valve to allow the refrigerant to flow therethrough in a state where the refrigerant is in an unexpanded state, and upon the heat pump mode, the expansion valve unit closes the on/off valve to allow the refrigerant to be expanded through the orifice and thus flow therethrough;

wherein the on/off valve is adapted to open and close a refrigerant passage formed at the inside thereof and has a valve member on which the orifice is formed and a motor mounted on one side thereof to rotate the valve member; and wherein upon receiving the mode change signal, the controller delays the opening/closing operation of the on/off valve for a second delay time and then conducts the opening/closing operation.

* * * * *